US011308845B2

(12) United States Patent
Kang

(10) Patent No.: US 11,308,845 B2
(45) Date of Patent: Apr. 19, 2022

(54) DISPLAY PANEL DRIVE METHOD AND DEVICE

(71) Applicants: HKC CORPORATION LIMITED, Guangdong (CN); CHONGQING HKC OPTOELECTRONICS TECHNOLOGY CO., LTD., Chongqing (CN)

(72) Inventor: Chih Tsung Kang, Chongqing (CN)

(73) Assignees: HKC Corporation Limited, Guangdong (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 0 days.

(21) Appl. No.: 16/769,183

(22) PCT Filed: Aug. 16, 2018

(86) PCT No.: PCT/CN2018/100761
§ 371 (c)(1),
(2) Date: Jun. 2, 2020

(87) PCT Pub. No.: WO2019/137003
PCT Pub. Date: Jul. 18, 2019

(65) Prior Publication Data

US 2021/0217345 A1 Jul. 15, 2021

(30) Foreign Application Priority Data

Jan. 10, 2018 (CN) ..... 201810022468.9

(51) Int. Cl.
*G09G 3/20* (2006.01)

(52) U.S. Cl.
CPC ... *G09G 3/2003* (2013.01); *G09G 2300/0452* (2013.01); *G09G 2320/028* (2013.01);
(Continued)

(58) Field of Classification Search
CPC ..... G09G 3/2003; G09G 2300/0452; G09G 2320/0276; G09G 2320/028; G09G 2320/0673; G09G 2360/16
See application file for complete search history.

(56) References Cited

U.S. PATENT DOCUMENTS 8,847,864 B2 9/2014 Zhang et al.
9,734,773 B2 8/2017 Kang et al.
(Continued)

FOREIGN PATENT DOCUMENTS

CN 102411914 A 4/2012
CN 103106884 A 5/2013
(Continued)

OTHER PUBLICATIONS

International Search Report for Application No. PCT/CN2018/100761 dated Nov. 20, 2018, 4 pages.

*Primary Examiner* — Kenneth B Lee, Jr.
(74) *Attorney, Agent, or Firm* — Rosenberg, Klein & Lee

(57) ABSTRACT

This application relates to a driving method of a display panel. The method includes: dividing sub pixels of the display panel into a plurality of sub pixel groups, each sub pixel group including the same quantity of color sub pixels; for each of the sub pixel groups, respectively adjusting a gamma value of a curve of brightness of each color sub pixel changing with a drive voltage; and for each sub pixel group, adjusting the adjusted gamma value according to a color property of the sub pixel group.

16 Claims, 8 Drawing Sheets

(52) U.S. Cl.
CPC ..... *G09G 2320/0276* (2013.01); *G09G 2320/0673* (2013.01); *G09G 2360/16* (2013.01)

(56) References Cited

U.S. PATENT DOCUMENTS

| | | | | |
|---|---|---|---|---|
| 2013/0135186 | A1 | 5/2013 | Zhang et al. | |
| 2016/0042711 | A1* | 2/2016 | Kim ..... | G09G 3/2003 345/691 |
| 2017/0162136 | A1 | 6/2017 | Kang et al. | |
| 2017/0169753 | A1 | 6/2017 | Hao et al. | |
| 2018/0211633 | A1* | 7/2018 | Peng ..... | G09G 5/10 |

FOREIGN PATENT DOCUMENTS

| | | | |
|---|---|---|---|
| CN | 103489400 | A | 1/2014 |
| CN | 104952410 | A | 9/2015 |
| CN | 105388649 | A | 3/2016 |
| CN | 106157918 | A | 11/2016 |
| CN | 106448609 | A | 2/2017 |
| CN | 108320716 | A | 7/2018 |
| JP | 4650845 | B2 | 3/2011 |

* cited by examiner

DISPLAY PANEL DRIVE METHOD AND DEVICE

CROSS REFERENCE TO RELATED APPLICATIONS

This is a U.S. National Stage application of, and claims priority to, PCT/CN2018/100761, filed Aug. 16, 2018, which further claims priority to Chinese Patent Application No. 201810022468.9, entitled "DISPLAY METHOD AND DEVICE OF DISPLAY PANEL", filed with the Chinese Patent Office on Jan. 10, 2018, the disclosures of which are incorporated herein by reference in their entirety.

TECHNICAL FIELD

This application relates to the field of display technologies, and more particularly relates to a drive method and device of a display panel.

BACKGROUND

An exemplary large-size liquid crystal display panel generally adopts a negative VA (Vertical Alignment) liquid crystal or IPS (In-Plane Switching) liquid crystal technology. The VA type liquid crystal technology has advantages of high production efficiency and low manufacturing costs compared with the IPS liquid crystal technology, however, its optical property has obvious optical property defects compared with the IPS liquid crystal technology, especially under the condition that the large-size panel needs large view angle presentation in the aspect of commercial application.

A tendency of saturation (namely, the tendency of a curve to flatten) of brightness of various sub pixels of the exemplary VA type liquid crystal panel at a side view angle is rapidly increased, especially under an intermediate or low drive voltage, the brightness is rapidly saturated, and a contrast is decreased, so that an obvious washout phenomenon (namely, a picture is partial white, and the brightness cannot linearly change with the drive voltage) appears when the picture is seen at a mixed view angle. In order to solve the aforementioned problem, an exemplary solution generally increases a gamma value, however, after the gamma value is increased, although the brightness contrast of the intermediate or low drive voltage at a side view angle can be improved, a brightness contrast changing with the drive voltage at a front view angle and a brightness contrast of high drive voltage at a side view angle are sacrificed, and an overall display effect of the display panel is still reduced.

SUMMARY

Accordingly, it is necessary to provide a drive method and device of a display panel for a problem that an overall display effect of the display panel is still reduced in an exemplary manner of enlarging a gamma value.

A drive method of a display panel includes:

dividing sub pixels of the display panel into a plurality of sub pixel groups, each sub pixel group including the same quantity of color sub pixels;

for each of the sub pixel groups, respectively adjusting a gamma value of a curve of brightness of each color sub pixel changing with a drive voltage; and for each of the sub pixel groups, adjusting the adjusted gamma value according to a color property of the sub pixel group.

A drive device of a display panel includes:

a pixel dividing module, used to divide sub pixels of the display panel into a plurality of sub pixel groups, each sub pixel group including the same quantity of color sub pixels;

a first adjustment module, used to: for each of the sub pixel groups, respectively adjust a gamma value of a curve of brightness of each color sub pixel changing with a drive voltage; and a second adjustment module, used to: for each of the sub pixel groups, adjust the adjusted gamma value according to a color property of the sub pixel group.

A drive method of a display panel includes:

dividing sub pixels of the display panel into a plurality of sub pixel groups, each sub pixel group including the same quantity of color sub pixels;

for each of the sub pixel groups, acquiring a difference curve between a curve of brightness of each type of color sub pixel changing with a drive voltage at a front view angle and a curve of brightness of each type of color sub pixel changing with a drive voltage at a side view angle, setting different drive voltage intervals according to the difference curve, and setting a set gamma value corresponding to each drive voltage interval, acquiring a drive voltage interval where a quantity of drive voltages distributed is greater than a set threshold, and setting the set gamma value corresponding to the acquired drive voltage interval as a gamma value of corresponding color sub pixel in the sub pixel group; and for each of the sub pixel groups, adjusting the adjusted gamma value according to a color property of the sub pixel group.

In the aforementioned drive method and device of the display panel, the display panel is divided into a plurality of sub pixel groups, and for each of the sub pixel groups, a gamma values of a curve of brightness of each color sub pixel changing with a drive voltage are respectively adjusted. Therefore, the aforementioned drive method and device of the display panel are equivalent to dividing the display panel into a plurality of blocks (namely, sub pixel groups), and then respectively and individually adjusting the gamma value of each block. Since the scope of the drive voltage involved in each block is small, simultaneous optimization of contrasts of brightness changing with the drive voltage at a front view angle and a side view angle is easily realized, thereby simultaneously embracing picture qualities at the front view angle and the side view angle. In addition, since the adjusted gamma value is adjusted according to a color property of the sub pixel group, the gamma value of each color sub pixel is further adaptively corrected by embracing an overall color distribution of the sub pixel group, thereby improving display effect of the display panel.

BRIEF DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

For ease of understanding, the following provides a more comprehensive description to this application with reference to the accompanying drawings. The accompanying drawings give preferred embodiments of this application. However, this application can be implemented in many different forms, and is not limited to the embodiments described in this application. Rather, the objective of providing these embodiments is to make the understanding of disclosed content of this application more thorough and comprehensive.

Figure 1:
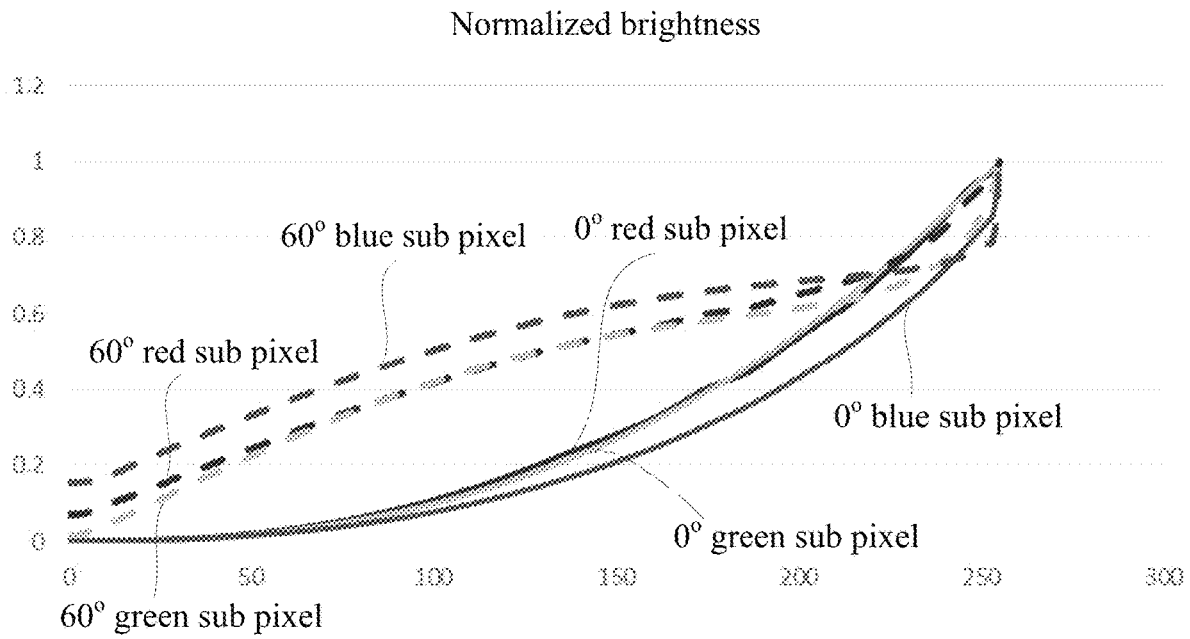
FIG. 1 is a diagram of a curve of brightness of a sub pixel changing with a drive voltage at a 0° angle and a 60° angle.
Figure 2:
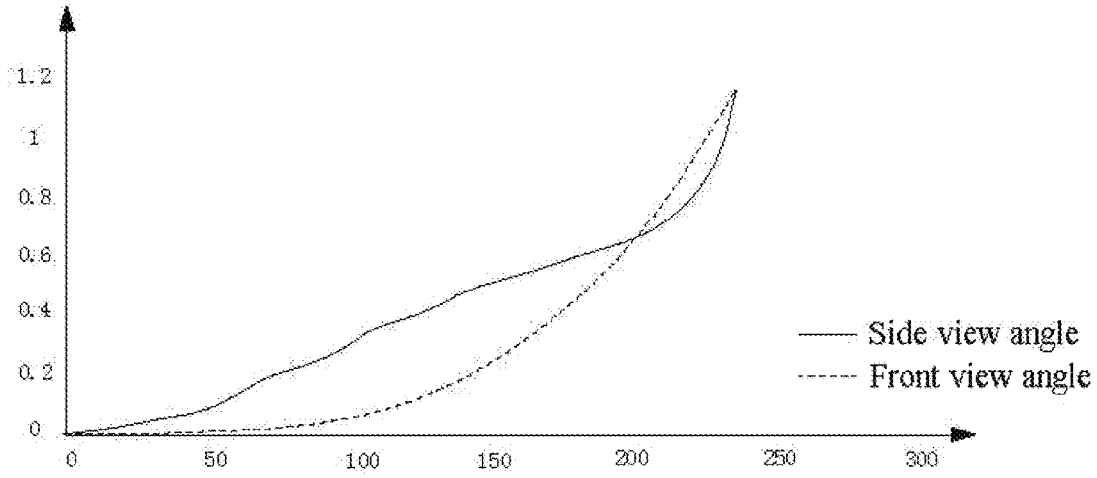
FIG. 2 is a diagram of a curve of brightness changing with a drive voltage at a front view angle and a side view angle after a gamma value is increased according to an example.

FIG. 1 shows a curve of brightness that is of an exemplary VA type liquid crystal panel and that changes with a drive voltage. A horizontal coordinate represents the drive voltage, a longitudinal coordinate represents the brightness, a solid line represents a 0° curve, and a dashed line represents a 60° curve. It can be seen from FIG. 1 that a tendency of saturation of brightness (namely, the tendency of a curve to flatten) of each sub pixel at a 60° side view angle is rapidly increased. Especially under an intermediate or low drive voltage, the brightness is rapidly saturated, and a contrast is decreased, so that an obvious washout phenomenon (namely, the picture is partial white, and the brightness cannot linearly change with the drive voltage) appears when a picture is watched at a mixed view angle. In order to overcome the aforementioned washout phenomenon, in an exemplary solution, a gamma value is generally increased. However, after the gamma value is increased, as shown in FIG. 2, although the brightness contrast under the intermediate or low drive voltage at a side view angle can be improved, a contrast of brightness changing with the drive voltage at a front view angle and a brightness contrast under a high drive voltage at a side view angle are sacrificed, and an overall display effect of the display panel is still reduced.

Figure 3:
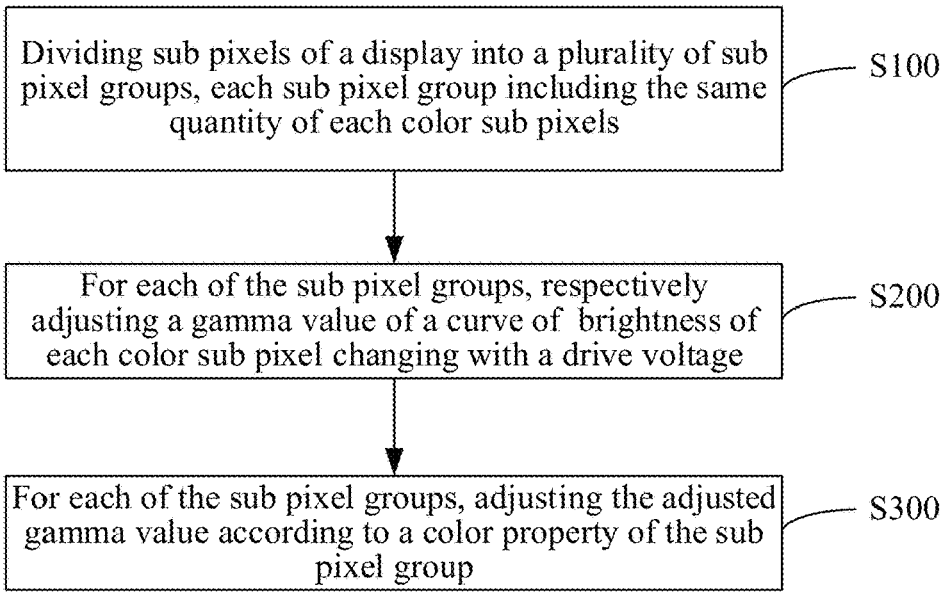
FIG. 3 a flowchart of a drive method of a display panel according to an implementation.

In order to solve the problem that the overall display effect of the display panel is still reduced in a manner of increasing the gamma value, one implementation provides a drive method of a display panel, which can be executed by a drive chip and is used for driving the display panel to display corresponding pictures. The display panel can be a TN (Twisted Nematic), OCB (Optically Compensated Birefringence), or VA (Vertical Alignment) type liquid crystal display panel, or a curved surface type liquid crystal display panel, but is not limited thereto. Referring to FIG. 3, the drive method of the display panel includes the following contents.

In Step S100, sub pixels of the display panel is divided into a plurality of sub pixel groups, and each sub pixel group includes the same quantity of color sub pixels.

Dividing the sub pixels of the display panel into the plurality of sub pixel groups is equivalent to partition the display panel. The display panel, for example, includes red sub pixels, blue sub pixels and green sub pixels. In other words, in this step, the red sub pixels on the display panel are divided into a plurality of red sub pixel groups, the green sub pixels on the display panel are divided into a plurality of green sub pixel groups, and the blue sub pixels on the display panel are divided into a plurality of blue sub pixel groups, and each sub pixel group includes one red sub pixel group, one green sub pixel group, and one blue sub pixel group, where the red sub pixel group, the green sub pixel group and the blue sub pixel group have the same quantity of sub pixels respectively.

Figure 4:
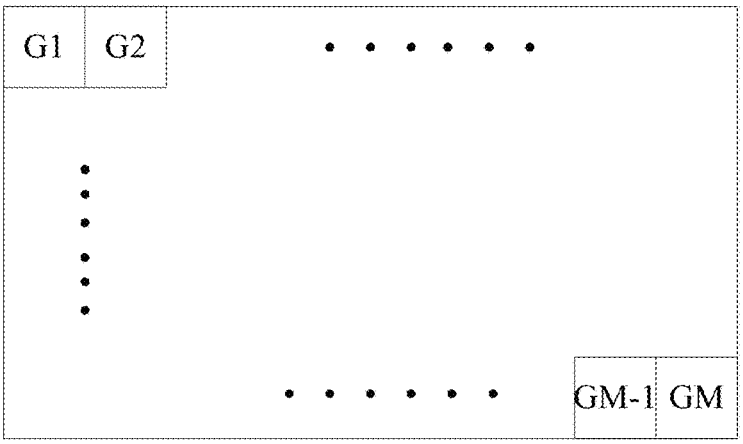
FIG. 4 is a schematic diagram of division of green sub pixels on a display panel according to an embodiment.
Figure 5:
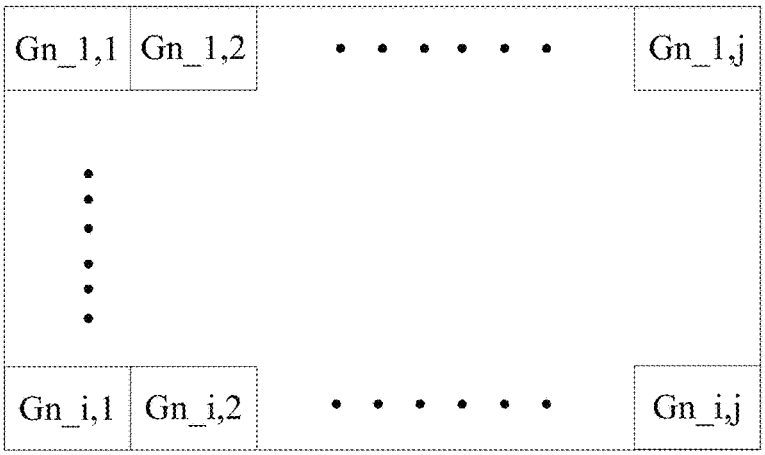
FIG. 5 is a schematic diagram of green sub pixel groups on the display panel according to the embodiment shown in FIG. 4.

Next, the green sub pixel is taken as an example for description, and reference is made to FIG. 4. All of the green sub pixels on the display panel are totally divided into M green sub pixel groups (G1, G2, . . . , and GM). Referring to FIG. 5, any green sub pixel group Gn (n=1, 2, . . . , or M) includes a plurality of green sub pixels (namely, Gn_1,1, Gn_1, 2, . . . , and Gn_i,j).

Therefore, in this implementation, dividing the sub pixels of the display panel into a plurality of sub pixel groups facilitates independent signal processing of each group of sub pixel groups, and may effectively process a property of brightness of a local sub pixel. In addition, the more the quantity of sub pixel groups on the display panel is, the higher the signal processing precision is, and therefore the quality of a displayed picture is better. The division quantity of the sub pixel groups can be adjusted according to an actual situation, thereby enlarging an application scope of this method.

In Step S200, for each sub pixel group, a gamma value of a curve of brightness of each color sub pixel changing with a drive voltage is adjusted respectively.

In other words, in this step, gamma values of curves of brightness of the red sub pixel, the green sub pixel and the blue sub pixel changing with the drive voltage are respectively adjusted in each sub pixel group.

The gamma value represents a nonlinear relationship between the brightness and the drive voltage. When the gamma values are different, situations that the brightness changes with the drive voltage are also different, which is described with examples below.

Figure 6:
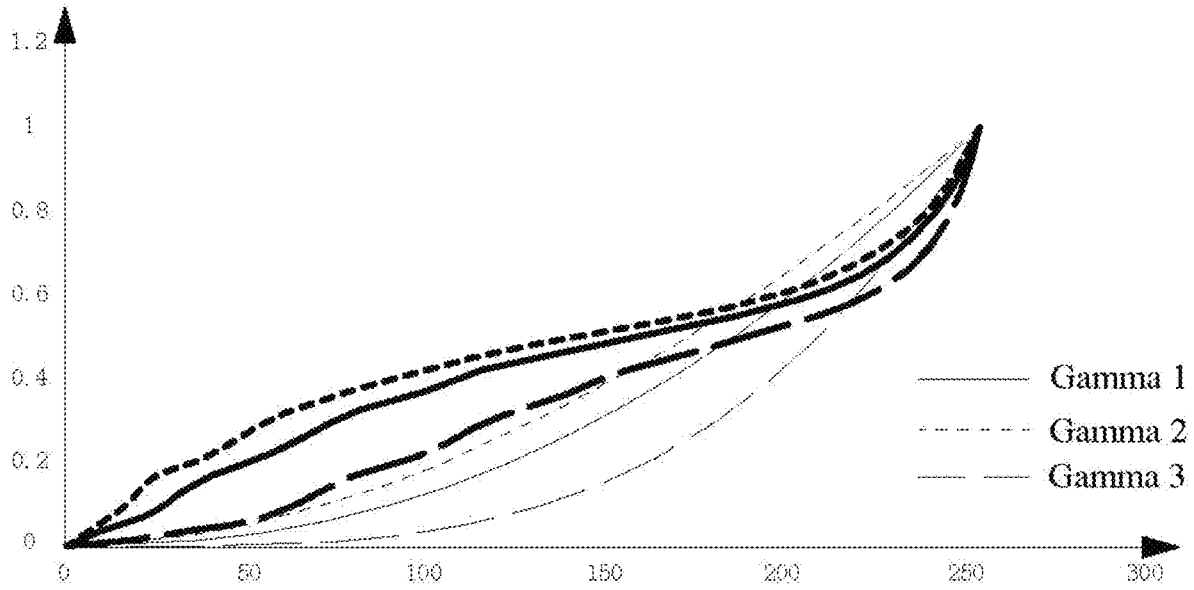
FIG. 6 is a schematic diagram of curves of brightness that has different gamma values and that changes with a drive voltage at a front view angle and a side view angle according to an embodiment.
Figure 7:
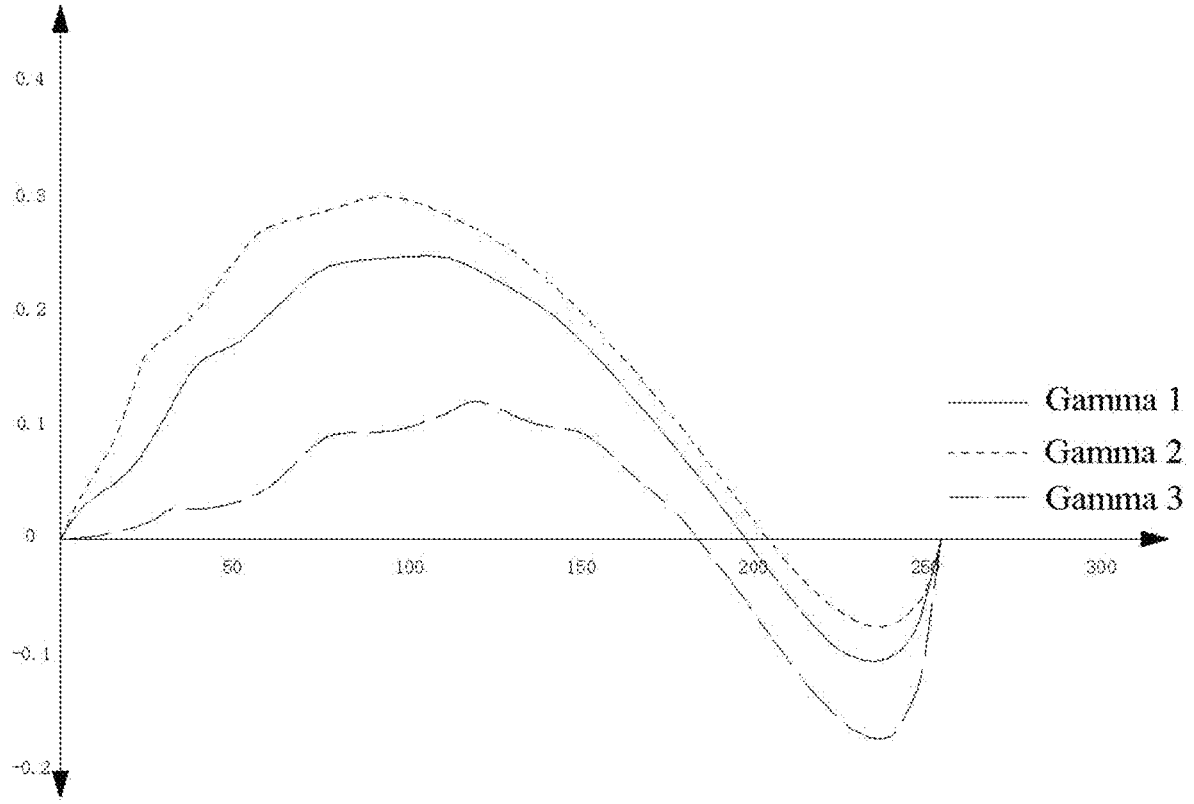
FIG. 7 is a schematic diagram of differences in brightness that has different gamma values and that changes with a drive voltage at a front view angle and a side view angle in the embodiment shown in FIG. 6.

FIG. 6 shows a schematic diagram of curves of brightness, having different gamma values and changing with a drive voltage, of one type of the color sub pixels at a front view angle and a side view angle. A horizontal coordinate represents the drive voltage, and a longitudinal coordinate represents a normalized brightness value. When the gamma value is gamma 1, curves of brightness changing with the drive voltage at the front view angle and the side view angle are respectively a lower curve gamma 1 and an upper bold curve gamma 1, and differences in brightness changes at the front view angle and the side view angle are shown in FIG. 7. As can be learned, the brightness at the side view angle is rapidly saturated with an increase of the drive voltage, especially, brightness corresponding to a low or intermediate drive voltage is rapidly saturated, resulting in poor comparability of picture qualities under the low or intermediate drive voltage.

If gamma 1 is increased, to adjust the gamma value from gamma 1 to gamma 3, curves of brightness changing with the drive voltage at the front view angle and the side view angle are respectively a lower curve gamma 3 and an upper bold curve gamma 3 in FIG. 6, and differences in the brightness changes at the front view angle and the side view angle are shown in FIG. 7. As can be learned, a phenomenon that the brightness at the side view angle is rapidly saturated with the drive voltage is relieved, brightness changes corresponding to a low or intermediate drive voltage is close to a linear tendency, thereby improving a comparability effect of picture qualities under the low or intermediate drive voltage. However, a linear tendency of brightness changes corresponding to the low drive voltage at the front view angle may be sacrificed, so that a resolution between the drive voltages is reduced, and meanwhile a resolution between brightness corresponding to the high drive voltage at the side view angle is also reduced.

If gamma 1 is reduced, after the gamma value is adjusted from gamma 1 to gamma 2, the curves of brightness changing with the drive voltage at the front view angle and the side view angle are respectively a lower curve gamma 2 and an upper bold curve gamma 2 in FIG. 6, and differences in brightness changes at the front view angle and the side view angle is shown in FIG. 7. As can be learned, with an increase of the drive voltage, a phenomenon that the brightness is rapidly saturated with the drive voltage at the side view angle is aggravated, and comparability of picture qualities under the low or intermediate drive voltage is further reduced.

It can be learned from the above contents that since the gamma values are adjusted as different values, observation effects at the front view angle and the side view angle can be simultaneously changed. However, if the gamma values of the display panel are uniformly adjusted, the gamma values may be increased to relieve a phenomenon that brightness corresponding to the intermediate or low drive voltage at the side view angle is rapidly saturated. However, since there are a relatively large quantity of drive voltages involved in the display panel, picture qualities corresponding to all the drive voltage intervals cannot be simultaneously balanced. As a result, not only a contrast of brightness corresponding to the drive voltage at the front view angle is reduced, namely, the picture quality at the front view angle is sacrificed, but also a contrast of brightness changes corresponding to the high drive voltage at the side view angle is reduced. Therefore, in a manner of uniformly adjusting the gamma values of the display panel, since there are a relatively large quantity of drive voltages involved, it is difficult to get one appropriate gamma value to simultaneously balance the picture qualities at the front view angle and the side view angle. In order to overcome the aforementioned problem, in this implementation, each gamma value corresponding to each sub pixel group is separately adjusted, so that a gamma value can be flexibly adjusted as adaptive to each sub pixel group according to actual picture quality content of each sub pixel group, namely, finally tendencies that the brightness of the sub pixel groups changing with the drive voltage are different. Since there are relatively fewer quantity of drive voltages involved in each sub pixel group, picture qualities at the front view angle and the side view angle are easily embraced at the same time, so that tendencies of brightness changing with the drive voltage at the front view angle and the side view angle are both close to a linear change rule.

One of manners of adjusting the gamma value is, for example, that for any type of color sub pixel, if the drive voltages of all these color sub pixels in a sub pixel group are mainly distributed in an intermediate or low drive voltage interval, the gamma values of the color sub pixels can be appropriately increased to improve the contrast of brightness corresponding to the intermediate and low voltages at the side view angle, and meanwhile, an upper limit value of the gamma value of the color sub pixel is controlled to ensure the resolution of brightness corresponding to an intermediate or low drive voltage at the front view angle.

Specifically, step S200 may be specifically: for each sub pixel group, respectively adjusting gamma values of curves of brightness of the color sub pixels changing with a drive voltage, so that difference values between the gamma values of curves of the color sub pixels corresponding to the side view angle and the front view angle of the whole display panel and 2.2 are all less than 2.2 (namely, close to 2.2). When the gamma value is 2.2, a linear change relationship of human eyes and the brightness is met, achieving a better display effect.

In Step S300, for each of the sub pixel groups, the adjusted gamma values is adjusted according to a color property of the sub pixel group.

The color property is, for example, saturation or hue. Color properties of different sub pixel groups of the display panel are possibly different. Since step S200 is respectively adjusting the gamma value corresponding to each color sub pixel in each sub pixel group, it is possible that a hue error phenomenon caused by a non-uniform RGB brightness proportion occurs, and therefore in this step, the adjusted gamma values of the aforementioned color sub pixels are compensated and corrected in combination with the overall color property of the sub pixel group. For example, the gamma value of the red sub pixel is increased or the gamma value of the green sub pixel is reduced, thereby reducing the hue error phenomenon caused by the non-uniform RGB brightness proportion.

In summary, the forgoing drive method of the display panel according to this embodiment is equivalent to dividing the display panel into a plurality of blocks (namely, sub pixel groups), and then respectively and individually adjusting gamma values for various blocks. Since the scope of the drive voltage involved in each block is small, simultaneous optimization of the contrasts of brightness changing with the drive voltage at the front view angle and the side view angle is easily realized, thereby embracing the picture qualities of the front view angle and the side view angle. In addition, since the adjusted gamma values are adjusted according to the color property of the sub pixel group, and adaptive correction is performed on the gamma values of the color sub pixels by embracing the overall color distribution of the sub pixel group, thereby improving the display effect of the display panel.

Figure 8:
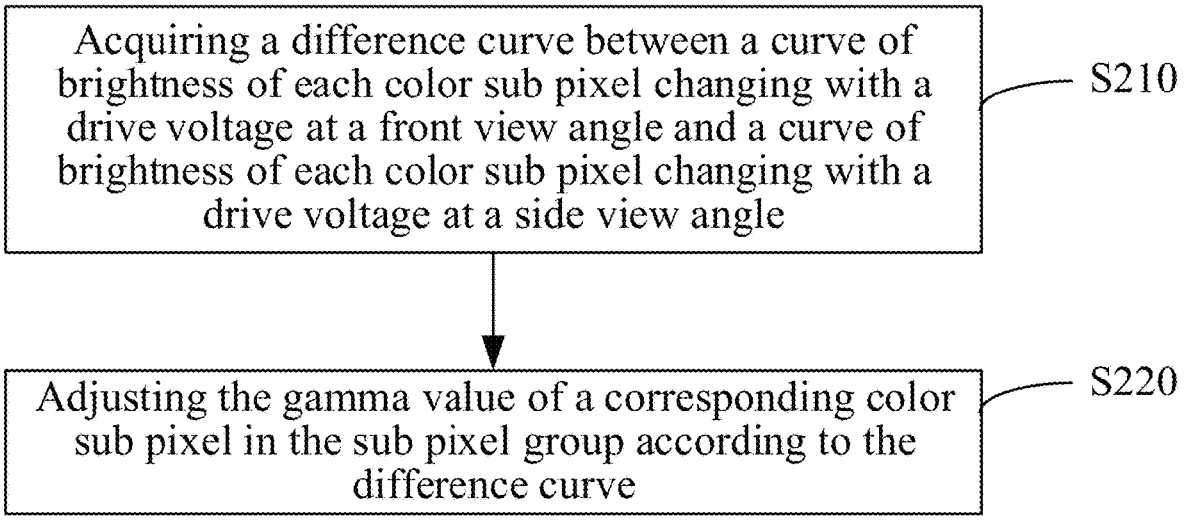
FIG. 8 is a flowchart of one of embodiments of step S200 in the drive method of the display panel according to the implementation shown in FIG. 3.

In one of the embodiments, referring to FIG. 8, the step of respectively adjusting the gamma values of the curves of brightness of various sub pixels changing with a drive voltage in the above step S200 includes the following contents.

In Step S210, a difference curve between a curve of brightness that is of each color sub pixel and that changes with the drive voltage at a front view angle and a curve of brightness of each type of color sub pixels changing with a drive voltage at a side view angle.

Figure 10:
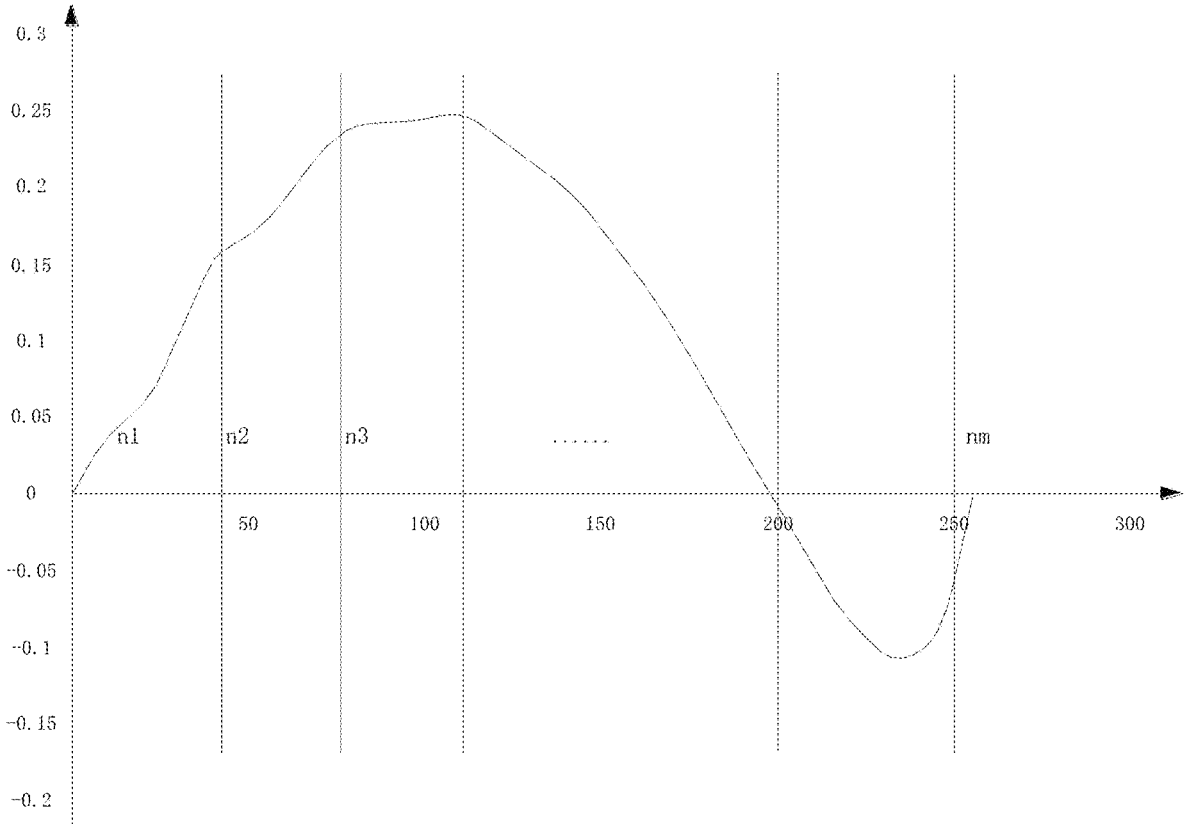
FIG. 10 is a schematic diagram of one of divisions of drive voltage intervals according to the embodiment shown in FIG. 9.

FIG. 10 provides a difference curve of one of types of color sub pixels according to an embodiment. In this difference curve, a horizontal coordinate represents the drive voltage, a longitudinal coordinate represents a difference value obtained by subtracting a brightness normalization value at the front view angle from a brightness normalization value at the side view angle. In addition, each type of color sub pixel has one corresponding difference curve.

In Step S220, a gamma value of a corresponding color sub pixel in the sub pixel group is adjusted according to the difference curve.

In other words, in each sub pixel group, the gamma value of the green sub pixels are adjusted according to a difference curve corresponding to the green sub pixels, the gamma value of the red sub pixel are adjusted according to a difference curve corresponding to the red sub pixels, and the gamma value of the blue sub pixel are adjusted according to a difference curve corresponding to the blue sub pixels.

Since the difference curve can reflect a difference of brightness between the front view angle and the side view angle, the smaller the difference between the front view angle and the side view angle is, the better the display effect is. Therefore, the gamma value is adjusted according to the difference curve, and the gamma value is correspondingly adjusted as to a difference between the front view angle and the side view angle at different drive voltage intervals, thereby facilitating achievement of an effect of reducing the brightness difference between the front view angle and the side view angle.

Figure 9:
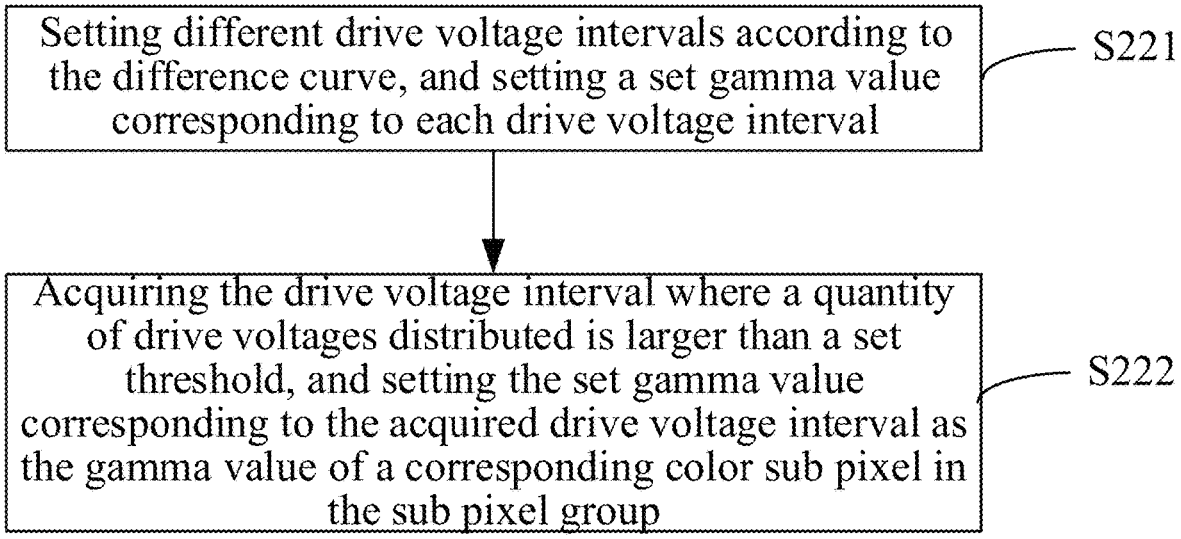
FIG. 9 is a flowchart of one of embodiments of step S200 according to the embodiment shown in FIG. 8.

Specifically, referring to FIG. 9, the aforementioned step S220 includes the following contents.

In Step S221, different drive voltage intervals are set according to the difference curve, and a set gamma value corresponding to each drive voltage interval is set.

The drive voltage interval is, for example, [n2, n3] in FIG. 10. Specifically, a quantity of the drive voltage intervals is greater than a set numerical value. The set gamma value corresponding to the drive voltage interval, namely, the gamma value adaptive to each drive voltage interval, can be set according to actual brightness of the drive voltage interval. For example, if the difference of brightness between the side view angle and the front view angle in the drive voltage interval is large, the set gamma value is a large value; and if the difference of brightness between the side view angle and the front view angle in the drive voltage interval is small, the set gamma value is a small value.

In Step S222, a drive voltage interval where the quantity of drive voltages distributed is greater than a set threshold is acquired, and a set gamma value corresponding to the acquired drive voltage interval is set as a gamma value of a corresponding color sub pixel in the sub pixel group.

Each sub pixel in the sub pixel group corresponds to one drive voltage, therefore the sub pixel group includes a plurality of drive voltages. The drive voltage interval where the quantity of drive voltages distributed is greater than the set threshold is acquired. For example, a drive voltage interval where the quantity of drive voltages distributed is maximum is acquired to acquire a main distribution interval of drive voltage of each color sub pixel in the sub pixel group. For example, if the proportion of the drive voltages of the red sub pixels in the sub pixel group in one of drive voltage intervals is higher than x % (where x % is, for example, between 60% and 100%), it is considered that this drive voltage interval is the main distribution interval of the drive voltages of the red sub pixels in this sub pixel group. The set gamma value corresponding to the acquired drive voltage interval is set as the gamma value of the corresponding color sub pixel in the sub pixel group, in other words, each color sub pixel in the sub pixel group adjusts the gamma value according to the mainly distributed drive voltage. For example, if the main distribution interval of the drive voltages of the red sub pixels in the sub pixel group is [n2, n3], the set gamma value corresponding to [n2, n3] is served as the adjusted gamma value of the red sub pixels in this sub pixel group.

In addition, if an objective of optimizing the gamma value is to make the curves of the front view angle and the side view angle close to a curve whose gamma value is the set target value (for example, 2.2), the more the division quantity of the drive voltage intervals is, the more the curves of the side view angle and the front side view are close to the curve whose gamma value is the set target value (for example, 2.2).

Figure 11:
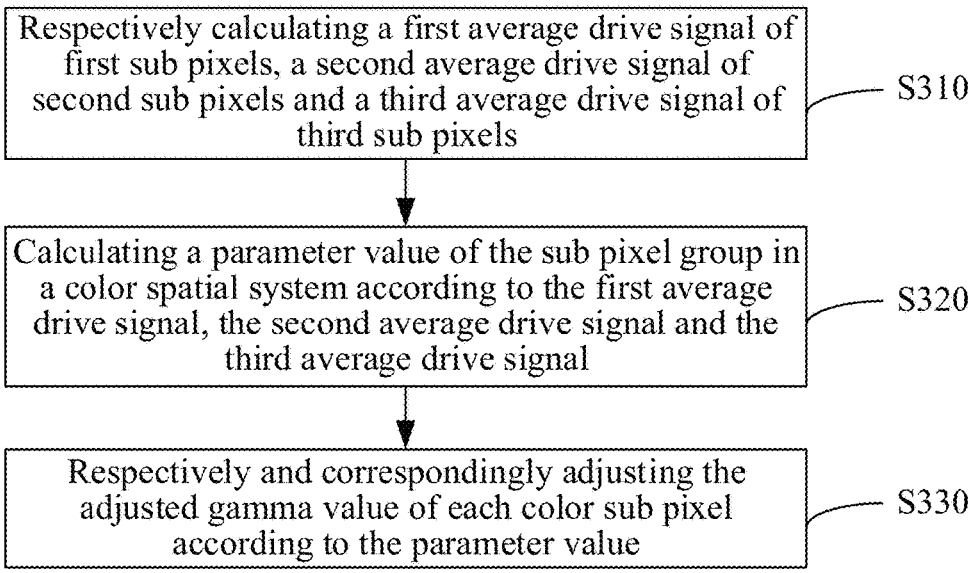
FIG. 11 is a flowchart of one of embodiments of step S300 in the drive method of the display panel according to the implementation shown in FIG. 3.

In one embodiment, each sub pixel group includes the same quantity of first sub pixels, second sub pixels, and third sub pixels, where the first sub pixels, the second sub pixels and the third sub pixels can be red sub pixels, green sub pixels, and blue sub pixels respectively. Furthermore, referring to FIG. 11, the step of adjusting the adjusted gamma value according to the color property of the sub pixel group in the aforementioned step S300 includes the following contents.

In Step S310, a first average drive signal of the first sub pixels, a second average drive signal of the second sub pixels, and a third average drive signal of the third sub pixels are calculated respectively.

The first average drive signal refers to a value obtained by adding drive signals of all the first sub pixels in one sub pixel group and then averaging. The second average drive signal refers to a value obtained by adding drive signals of all the second sub pixels in one sub pixel group and then averaging. The third average drive signal refers to a value obtained by adding drive signals of all the third sub pixels in one sub pixel group and then averaging.

Taking that the first sub pixels, the second sub pixels, and the third sub pixels are respectively red sub pixels, green sub pixels and blue sub pixels as an example, the first average drive signal Rn', the second average drive signal Gn', and the third average drive signal Bn' are respectively:

$$Rn'=\text{Average}(Rn_1,1,Rn_1,2, \ldots ,Rn_2,1, Rn_2,2, \ldots, \text{and } Rn_i,j);$$

$$Gn'=\text{Average}(Gn_1,1,Gn_1,2, \ldots ,Gn_2,1, Gn_2,2, \ldots, \text{and } Gn_i,j); \text{ and}$$

$$Bn'=\text{Average}(Bn_1,1,Bn_1,2, \ldots ,Bn_2,1, Bn_2,2, \ldots, \text{and } Bn_i,j),$$

Rn_1,1, . . . , and Rn_i,j represent the red sub pixels. Gn_1,1, . . . , and Gn_i,j represent the green sub pixels. Bn_1,1, . . . , and Bn_i,j represent the blue sub pixels.

In Step S320, a parameter value of the sub pixel group in a color spatial system is calculated according to the first average drive signal, the second average drive signal, and the third average drive signal.

Figure 12:
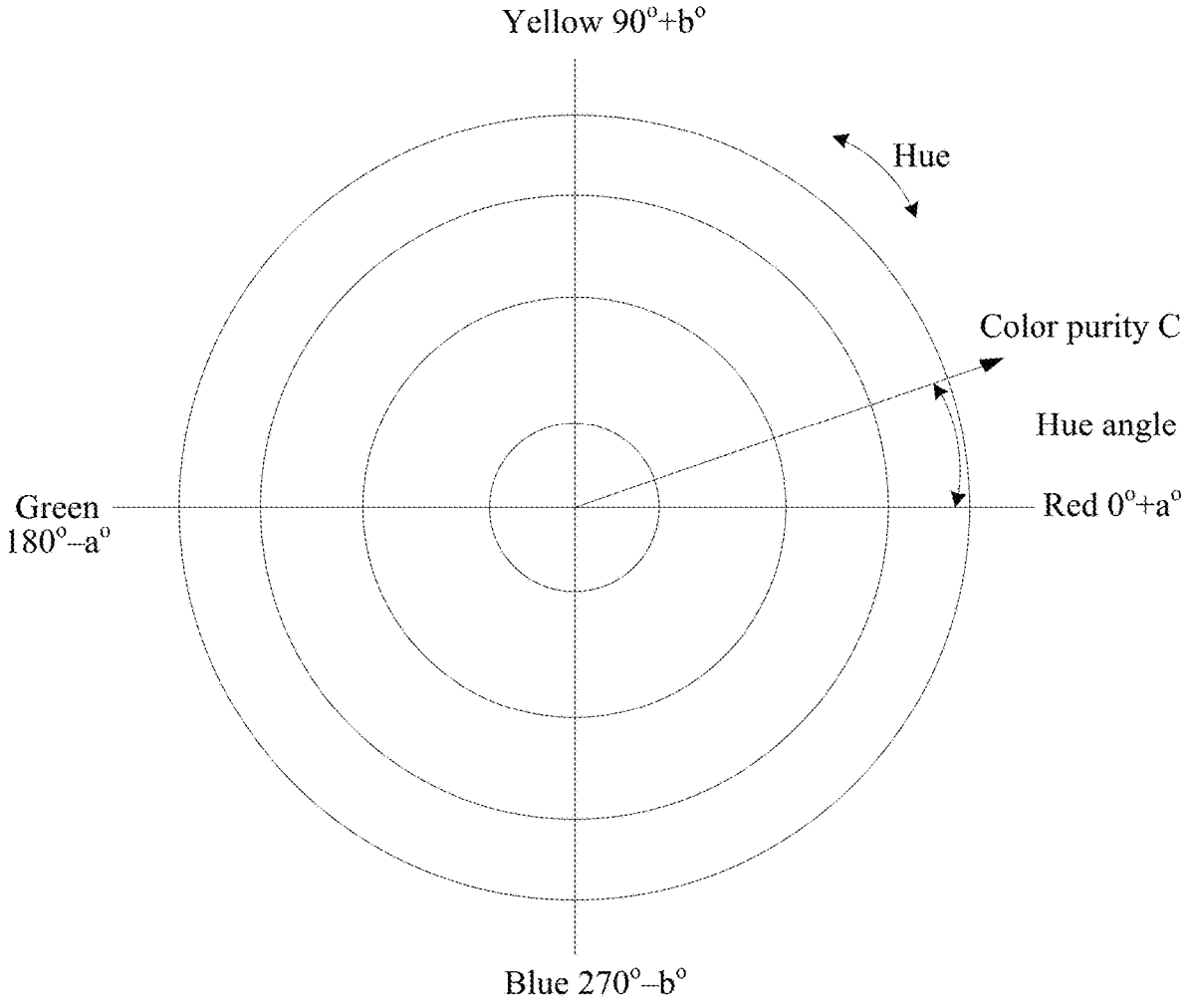
FIG. 12 is a schematic diagram of a CIE LCH color spatial system according to an embodiment.

The color spatial system is, for example, a CIE LCH color spatial system. The CIE LCH color spatial system is shown in FIG. 12, where L represents a brightness value or a lightness value, C represents a saturation value or a purity value, and H represents a hue or a hue angle value. The range of C is represented from 0 to 100, and 100 represents the brightest color. 0° to 360° are used to represent color presentations of different hues. 0° is defined as red, 90° is defined as yellow, 180° is defined as green, and 270° is defined as blue. Specifically, L=f1(R, G, B), C=f2(R, G, B) and H=f3(R, G, B), where aforementioned function relationships can be known according to a CIE criterion. Therefore, L, C and H of each sub pixel group can be calculated according to the average drive signals of the color sub pixels calculated in step S310. For example, H=f3(Rn', Gn', Bn'), and C=f2(Rn', Gn', Bn').

In Step S330, the adjusted gamma value of each color sub pixel is adjusted respectively and correspondingly according to the parameter value.

The gamma value of each color sub pixel can be correspondingly adjusted according to different parameter values, for example, the adjusted gamma value of each color sub pixel can be increased or decreased. Specifically, the parameter value includes a saturation value and a hue value.

Further, on the premise that the parameter value includes a saturation value and a hue value, the aforementioned step S330 can be that when determining that the saturation value is between a first saturation threshold and a second saturation threshold, the adjusted gamma value of each color sub pixel is adjusted respectively and correspondingly.

Specifically, when the saturation value is between the first saturation threshold and the second saturation threshold, it corresponds to a situation that a hue error phenomenon at the side view angle of the display panel is the most serious. In other words, the adjusted gamma value of each color sub pixel is adjusted only under the condition that the hue error phenomenon at the side view angle of the display panel is the most serious, so as to avoid waste of resources. The first saturation value and the second saturation value depend on own feature of the display panel.

Further, the aforementioned step that when determining that the saturation value is between the first saturation threshold and the second saturation threshold, the adjusted gamma value of each color sub pixel is respectively and correspondingly adjusted includes: when determining that the saturation value is between the first saturation threshold and the second saturation threshold, the adjusted gamma value of each color sub pixel is adjusted in different manners under the condition that the hue value is in different intervals.

The hue value in different intervals represents different colors. Gamma values of sub pixel groups in different colors are adaptively adjusted, so that macroscopic flicker possibly caused by frequent gamma compensation of various blocks can be reduced, and an unsmooth transition phenomenon caused by differences of gamma values between various blocks can also be reduced.

Specifically, intervals where hue values fall, for example, include: a first interval: 0°<H≤45° and 315°<H≤360°; a second interval: 45°<H≤135°; a third interval: 135°<H≤205°; a fourth interval: 205°<H≤245°; a fifth interval: 245°<H≤295°; and a sixth interval: 295°<H≤315°. When the hue value is in the aforementioned different intervals, the gamma value of each color sub pixel can be respectively adjusted to different degrees.

Figure 13:
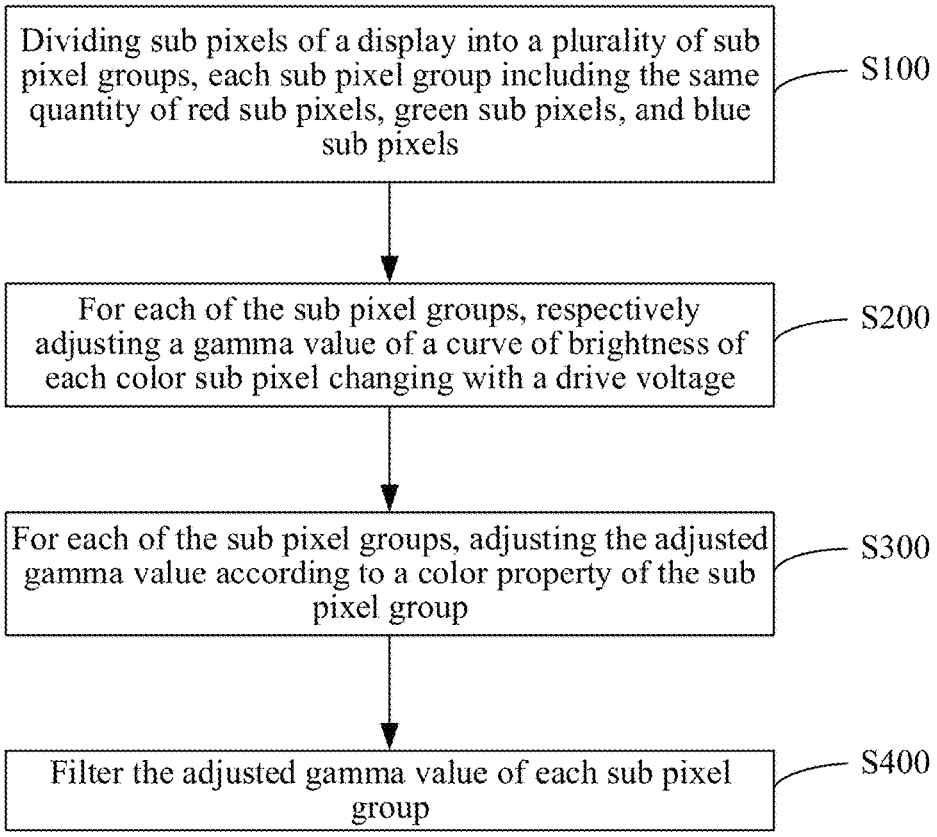
FIG. 13 is a flowchart of one of embodiments of the drive method of the display panel according to the implementation shown in FIG. 3.
Figure 14:
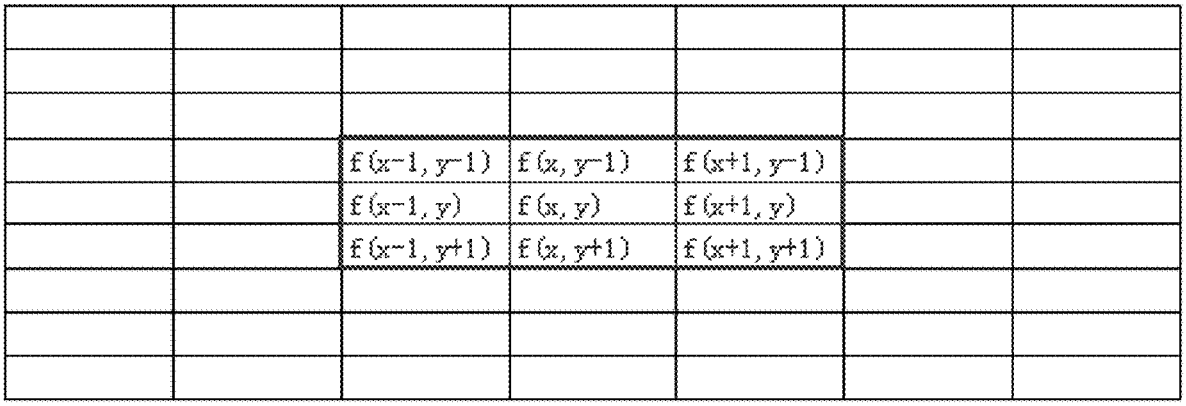
FIG. 14 is a schematic diagram of filtering involved in step S400 in the drive method of the display panel according to the embodiment shown in FIG. 13.

In one of the embodiments, referring to FIG. 13, after step S300, the above drive method of the display panel further includes the following contents.

In Step S400, the adjusted gamma value of each sub pixel group is filtered.

For any color sub pixel, since a difference exists in main distribution intervals of drive voltages among various sub pixel groups, there is also a corresponding difference between the adjusted gamma values of different sub pixel groups, and therefore tendencies of brightness of the sub pixel groups changing with the drive voltage are different. The difference of brightness between adjacent sub pixel groups can generate a macroscopic unsmooth transition boundary phenomenon at adjacent positions between two sub pixel groups. In order to solve or relieve the aforementioned problem, in this embodiment, the gamma value of each sub pixel group on the display panel are further filtered after being adjusted to eliminate the unsmooth transition phenomenon.

Specifically, the gamma value of each sub pixel group can be filtered by using a spatial filtering function. For example, referring to FIG. 13, taking green sub pixels as an example, each box represents one green sub pixel group. All the green sub pixels on the display panel are divided into 9*7=63 sub pixel groups. Taking the sub pixel group located in the middle as an example, when the gamma value of this sub pixel group is filtered, the following formula is adopted:

$$g(x,y)=w1*f(x-1,y-1)+w2*f(x-1,y)+w3*f(x-1,y+1)+w4*f(x,y-1)+w5*f(x,y)+w6*f(x,y+1)+w7*f(x+1,y-1)+w8*f(x+1,y)+w9*f(x+1,y+1).$$

f(x,y) represents the gamma value of the green sub pixel group located in the middle before filtering. g(x,y) represents the gamma value of the green sub pixel group located in the middle after filtering. f(x−1,y−1), f(x−1,y), . . . , and f(x+1,y+1) represent gamma values of the green sub pixel groups surrounding the green sub pixel group located in the middle. w1, w2, . . . , and w9 represent weights at various positions in the spatial low pass filtering function. This spatial low pass filtering function can effectively relieve the unsmooth transition phenomenon caused by difference of gamma values between the sub pixel groups.

It should be noted that FIG. 3, FIG. 8, FIG. 9, FIG. 11, and FIG. 13 are flowcharts of methods according to embodiments of this application. It should be understood that although various steps in the flowcharts in FIG. 3, FIG. 8, FIG. 9, FIG. 11, and FIG. 13 are displayed in sequence according to indication of arrows, these steps are not necessarily performed according to the sequence indicated by the arrows. Otherwise explicitly stated herein, these steps are performed without a strict sequence restriction, and can be performed in other sequences. Furthermore, at least some steps in FIG. 3, FIG. 8, FIG. 9, FIG. 11 and FIG. 13 can include a plurality of sub steps or a plurality of stages, these sub steps or stages are not necessarily completed at the same moment and can be performed at different moments, and they are not necessarily performed in turn and can be performed by turns or alternatively with other steps or sub steps of other steps or at least one part of stages.

Figure 15:
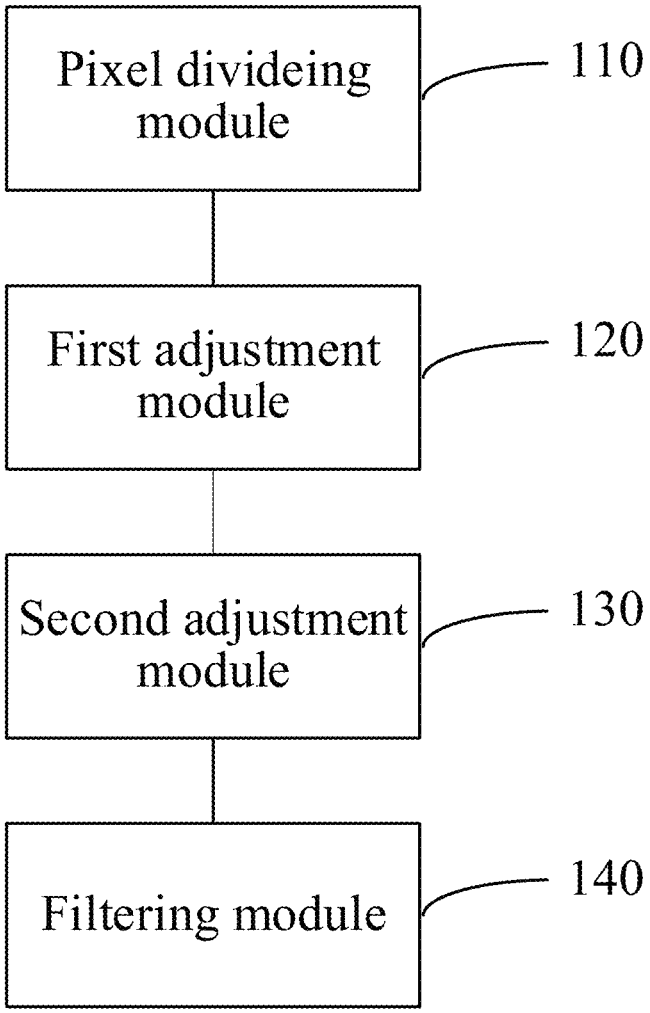
FIG. 15 is a block diagram of a drive device of a display panel according to another implementation.

Referring to FIG. 15, in another implementation, a drive device of a display panel is provided, which includes:

a pixel dividing module 110, used to divide sub pixels of the display panel into a plurality of sub pixel groups, each sub pixel group including the same quantity of the color sub pixels;

a first adjustment module 120, used to: for each of the sub pixel groups, respectively adjust a gamma value of a curve of brightness of each color sub pixel changing with a drive voltage; and a second adjustment module 130, used to: for each of the sub pixel groups, adjust the adjusted gamma value according to a color property of the sub pixel group.

In one of the embodiments, the first adjustment module 120 includes:

a curve acquiring unit, used to acquire a difference curve between a curve of brightness of each type of color sub pixel changing with a drive voltage at a front view angle and a curve of brightness of each type of color sub pixel changing with a drive voltage at a side view angle; and a gamma value adjustment unit, used to adjust a gamma value of a corresponding color sub pixel in the sub pixel group according to the difference curve.

In one of the embodiments, the gamma value adjustment unit includes:

an interval setting subunit, used to set different drive voltage intervals according to the difference curve, and set a set gamma value corresponding to each drive voltage interval; and a gamma value setting subunit, used to acquire a drive voltage interval where a quantity of drive voltages distributed is greater than a set threshold, and set the set gamma value corresponding to the acquired drive voltage interval as a gamma value of a corresponding color sub pixel in the sub pixel group.

In one of the embodiments, each sub pixel group include the same quantity of first sub pixels, second sub pixels, and third sub pixels; and the second adjustment module 130 includes:

an average drive signal calculation unit, used to respectively calculate a first average drive signal of the first sub pixels, a second average drive signal of the second sub pixels, and a third average drive signal of the third sub pixels;

a parameter value acquiring unit, used to calculate a parameter value of the sub pixel group in a color spatial system according to the first average drive signal, the second average drive signal, and the third average drive signal; and a re-adjustment unit, used to correspondingly adjust the adjusted gamma value of each color sub pixel according to the parameter value, respectively.

In one of the embodiments, the parameter value includes a saturation value and a hue value.

In one of the embodiments, the re-adjustment unit is used to: when determining that the saturation value is between a first saturation threshold and a second saturation threshold, respectively adjust the adjusted gamma value of each color sub pixel.

In one of the embodiments, the re-adjustment unit is used to: when determining that the saturation value is between the first saturation threshold and the second saturation threshold, respectively adjust the adjusted gamma value of each color sub pixel in different manners under the condition that the hue value is in different intervals.

In one of the embodiments, continuing to refer to FIG. 15, the drive device of the display panel further includes:

a filtering module 140, used to filter the adjusted gamma value of each sub pixel group.

It should be noted that the drive device of the display panel according to this embodiment corresponds to the drive method of the display panel according to the aforementioned embodiments, which is not described in detail herein.

It should be noted that the drive device of the display panel according to this embodiment can be applied to a display device, where the display device is, for example, an LCD (Liquid Crystal Display) display device, an OLED (Organic Light-Emitting Diode) display device, a QLED (Quantum Dot Light Emitting Diodes) display device, a curved surface display device, or other display devices.

Various technical features in the foregoing embodiments may be combined randomly. For ease of description, not all possible combinations of various technical features in the foregoing embodiments are described. However, the combinations of the technical features should be considered as falling within the scope recorded in this specification provided that the combinations of the technical features are compatible with each other.

The foregoing embodiments only describe several implementations of this application, which are described specifically and in detail, and therefore cannot be construed as a limitation to the patent scope of the present invention. It should be noted that, a person of ordinary skill in the art may make various changes and improvements without departing from the ideas of this application, which shall all fall within the protection scope of this application. Therefore, the protection scope of the patent of this application shall be subject to the appended claims.

What is claimed is:

1. A drive method of a display panel, comprising:

dividing sub pixels of the display panel into a plurality of sub pixel groups, each sub pixel group comprising the same quantity of color sub pixels;

for each of the sub pixel groups, respectively adjusting a gamma value of a curve of brightness of each color sub pixel changing with a drive voltage, comprising:

acquiring a difference curve between a curve of brightness of each type of color sub pixel changing with a drive voltage at a front view angle and a curve of brightness of each type of color sub pixel changing with a drive voltage at a side view angle; and adjusting the gamma value of a corresponding color sub pixel in the sub pixel group according to the difference curve, comprising:

setting different drive voltage intervals according to the difference curve, and setting a set gamma value corresponding to each drive voltage interval; and acquiring the drive voltage interval where a quantity of drive voltages distributed is greater than a set threshold, and setting the set gamma value corresponding to the acquired drive voltage interval as the gamma value of the corresponding color sub pixel in the sub pixel group; and for each of the sub pixel groups, adjusting the adjusted gamma value according to a color property of the sub pixel group.

2. The method according to claim 1, wherein each sub pixel group comprises the same quantity of first sub pixels, second sub pixels, and third sub pixels; and the step of adjusting the adjusted gamma value according to the color property of the sub pixel group comprises:

respectively calculating a first average drive signal of the first sub pixels, a second average drive signal of the second sub pixels, and a third average drive signal of the third sub pixels;

calculating a parameter value of the sub pixel group in a color spatial system according to the first average drive signal, the second average drive signal, and the third average drive signal; and respectively and correspondingly adjusting the adjusted gamma value of each color sub pixel according to the parameter value.

3. The method according to claim 2, wherein the parameter value comprises a saturation value and a hue value.

4. The method according to claim 3, wherein the step of respectively and correspondingly adjusting the adjusted gamma value of each color sub pixel according to the parameter value comprises:

when determining that the saturation value is between a first saturation threshold and a second saturation threshold, respectively and correspondingly adjusting the adjusted gamma value of each color sub pixel.

5. The method according to claim 4, wherein the step of when determining that the saturation value is between the first saturation threshold and the second saturation threshold, respectively and correspondingly adjusting the adjusted gamma value of each color sub pixel comprises:

when determining that the saturation value is between the first saturation threshold and the second saturation threshold, respectively adjusting the adjusted gamma value of each color sub pixel in different manners under the condition that the hue value is in different intervals.

6. The method according to claim 5, wherein the intervals where the hue value falls comprises a first interval, a second interval, a third interval, a fourth interval, a fifth interval, and a sixth interval;

the first interval is $0°<H\leq 45°$ and $315°<H\leq 360°$; the second interval is $45°<H\leq 135°$; the third interval is $135°<H\leq 205°$; the fourth interval is $205°<H\leq 245°$; the fifth interval is $245°<H\leq 295°$; and the sixth interval is $295°<H\leq 315°$, wherein H is the hue valve.

7. The method according to claim 1, wherein after the step of for each of the sub pixel groups, adjusting the adjusted gamma value according to the color property of the sub pixel group, the method further comprising:

filtering the adjusted gamma value of each sub pixel group.

8. The method according to claim 1, wherein after the step of for each of the sub pixel groups, adjusting the adjusted gamma value according to the color property of the sub pixel group, the method further comprising:

filtering the adjusted gamma value of each the sub pixel group using a spatial low pass filtering function, the spatial low pass filtering function having an expression as follows:

$$g(x,y)=w1*f(x-1,y-1)+w2*f(x-1,y)+w3*f(x-1,y+1)+w4*f(x,y-1)+w5*f(x,y)+w6*f(x,y+1)+w7*f(x+1,y-1)+w8*f(x+1,y)+w9*f(x+1,y+1),$$

wherein f(x,y) represents the gamma value of a set sub pixel group before filtering; g(x,y) represents the gamma value of the set sub pixel group after filtering; f(x−1,y−1), f(x−1,y), . . . , and f(x+1,y+1) represent the gamma values of the sub pixel groups surrounding the set sub pixel group; and w1, w2, . . . , and w9 represent weights of various positions in the spatial low pass filtering function.

9. A drive device of a display panel, comprising:

a pixel dividing module, configured to divide sub pixels of the display panel into a plurality of sub pixel groups, each sub pixel group comprising various color sub pixels having the same quantity;

a first adjustment module, configured to: for each of the sub pixel groups, respectively adjust a gamma value of a curve of brightness of each color sub pixel changing with a drive voltage, wherein the first adjustment module comprises:

a curve acquiring unit, configured to acquire a difference curve between a curve of brightness of each type of color sub pixel changing with a drive voltage at a front view angle and a curve of brightness of each type of color sub pixel changing with a drive voltage at a side view angle; and a gamma value adjustment unit, configured to adjust a gamma value of a corresponding color sub pixel in the sub pixel group according to the difference curve, wherein the gamma value adjustment unit comprises:

an interval setting subunit, configured to set different drive voltage intervals according to the difference curve, and set a set gamma value corresponding to each drive voltage interval; and a gamma value setting subunit, configured to acquire a drive voltage interval where quantity of drive voltages distributed is greater than a set threshold, and setting the set gamma value of the acquired drive voltage interval as the gamma value of a corresponding color sub pixel in the sub pixel group; and a second adjustment module, configured to: for each of the sub pixel groups, adjust the adjusted gamma value according to a color property of the sub pixel group.

10. The drive device according to claim 9, wherein the sub pixel groups comprise the same quantity of first sub pixels, second sub pixels, and third sub pixels; and the second adjustment module comprises:

an average drive signal calculation unit, configured to respectively calculate a first average drive signal of the first sub pixels, a second average drive signal of the second sub pixels and a third average drive signal of the third sub pixels;

a parameter value acquiring unit, configured to calculate a parameter value of the sub pixel group in a color spatial system according to the first average drive signal, the second average drive signal and the third average drive signal; and a re-adjustment unit, configured to respectively and correspondingly adjust the adjusted gamma value of each color sub pixel according to the parameter value.

11. The drive device according to claim 10, wherein the parameter value comprises a saturation value and a hue value.

12. The drive device according to claim 11, wherein the re-adjustment unit is configured to: when determining that the saturation value is between a first saturation threshold and a second saturation threshold, respectively and correspondingly adjust the adjusted gamma value of each color sub pixel.

13. The drive device according to claim 12, wherein the re-adjustment unit is configured to: when determining that the saturation value is between the first saturation threshold and the second saturation threshold, respectively adjust the adjusted gamma value of each color sub pixel in different manners under the condition that the hue value is in different intervals.

14. The drive device according to claim 13, wherein the intervals where the hue value falls comprises a first interval, a second interval, a third interval, a fourth interval, a fifth interval and a sixth interval;

the first interval is $0°<H\leq 45°$ and $315°<H\leq 360°$; the second interval is $45°<H\leq 135°$; the third interval is $135°<H\leq 205°$; the fourth interval is $205°<H\leq 245°$; the fifth interval is 245°<H≤295°; and the sixth interval is 295°<H≤315°, wherein H is the hue valve.

15. The drive device according to claim 9, wherein the drive device of the display panel further comprising:

a filtering module, configured to filter the adjusted gamma value of each sub pixel group.

16. A drive method of a display panel, comprising:

dividing sub pixels of the display panel into a plurality of sub pixel groups, each sub pixel group comprising various color sub pixels of the same quantity;

for each of the sub pixel groups, acquiring a difference curve between a curve of brightness of each type of color sub pixel changing with a drive voltage at a front view angle and a curve of brightness of each type of color sub pixel changing with a drive voltage at a side view angle, setting different drive voltage intervals according to the difference curve and setting a set gamma value corresponding to each drive voltage interval, acquiring the drive voltage interval where a quantity of drive voltages distributed is greater than a set threshold, and setting the set gamma value of the acquired drive voltage interval as the gamma value of a corresponding color sub pixel in the sub pixel group; and for each of the sub pixel groups, adjusting the adjusted gamma value according to a color property of the sub pixel group.

* * * * *